United States Patent [19]

Schoeps et al.

[11] 4,002,859

[45] Jan. 11, 1977

[54] MULTI-MODE ELECTROSTATIC MICROPHONE CONSTRUCTION

[75] Inventors: Karl Schoeps, Karlsruhe; Joerg Wuttke, Pfinztal, Berghausen, both of Germany

[73] Assignee: Schalltechnik Dr. Schoeps, Karlsruhe, Germany

[22] Filed: Nov. 5, 1974

[21] Appl. No.: 521,150

[30] Foreign Application Priority Data

Nov. 8, 1973 Germany ..... 2355778

[52] U.S. Cl. ..... 179/146 R
[51] Int. Cl. ..... H04r 1/00
[58] Field of Search ..... 179/146 R, 178, 179, 179/1 PC

[56] References Cited

UNITED STATES PATENTS 3,201,530 8/1965 Levy et al. ..... 179/146 R

FOREIGN PATENTS OR APPLICATIONS 2,138,750 2/1973 Germany ..... 179/146 R
1,046,866 10/1966 United Kingdom ..... 179/146 R

*Primary Examiner*—William C. Cooper
*Attorney, Agent, or Firm*—Michael J. Striker

[57] ABSTRACT

A set of components is disclosed containing various microphones, a microphone amplifier, and an impedance converter, all arranged to be connected together in different combinations, with electrical contact automatically made between them.

16 Claims, 5 Drawing Figures

MULTI-MODE ELECTROSTATIC MICROPHONE CONSTRUCTION

BACKGROUND OF THE INVENTION

The invention relates to an arrangement for a condenser microphone with a miniaturized accessory comprised of a housing with which an electrostatic transducer is connected, preferably replaceably.

In the recording of sound it is frequently necessary to keep the use of the microphone as inconspicuous as possible. This state of facts is taken into account, in the case of condenser microphones, by separating the transducer from the matching circuit, i.e., from the amplifier for the condenser microphone. It is already recognized that the transducer and the microphone amplifier, because of the high-impedance character of the transducer, should be kept as close to each other as possible. However, it may also be desired to alternatively employ a condenser microphone without separating such components from each other (compact mode); this presupposes that the removability of the transducer from the condenser-microphone amplifier is provided for in the actual construction of the microphone. This is always the case when transducers having different acoustical characteristics are to be interchangeably connectable to one and the same condenser-microphone amplifier. Such interchangeability is ever more in demand.

It is known to perform the separation of components using an intermediate metallic pipe through which run the connecting conductors for the separated components. Such pipe carries at its ends electrical contacts and mechanical connecting means. Because the construction is rigid, it is necessary, if different applications are foreseen, to keep available intermediate pipes of different lengths and having different configurations, e.g., bends. Additionally, there is the great disadvantage that the signal-to-noise ratio when the components are separated is inferior to the signal-to-noise ratio when the components are compactly arranged. This consideration, besides constituting a disadvantage in itself, in effect places limits upon the lengths of such pipes.

It is also known to so design the microphone that the removable transducer is united with certain circuit components of the microphone amplifier in such a manner that the combination of the transducer and such circuit components is connected to the rest of the microphone amplifier circuitry by means of connecting leads only after a transformation of the high output impedance of the transducer. In this way, a deterioration of the signal-to-noise ratio resulting upon separation of the transducer is avoided. However, in the alternative mode of use, i.e., in the compact arrangement, there will exist two electrical and mechanical dismantling points; besides the increased cost of such an expedient, there results additionally a decrease in overall operating reliability. Furthermore, the electrical connection extending from the transducer must be so designed as to be capable of being separated. As a result, larger dimensions become necessary for the separated module than would be required for a similar non-separable connection.

SUMMARY OF THE INVENTION

It is an object of the invention to provide a condenser microphone so constructed as to permit separation of the transducer from the condenser-microphone amplifier, without making sacrifices in the quality of the microphone performance.

This object, and others which will become more understandable from the description, below, of a preferred embodiment, can be met, according to one advantageous concept of the invention, by providing a microphone construction such that upon removal of the transducer use is made of an arrangement comprised of a condenser microphone and a miniaturized accessory in turn comprised of a housing with which is connected an electrostatic transducer, preferably replaceably, with such housing containing at least one impedance converter circuit having high input impedance, the impedance transformer circuit by means of corresponding electrical contacts being connectable in place of the transducer to the high-impedance input of the condenser-microphone amplifier.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2:
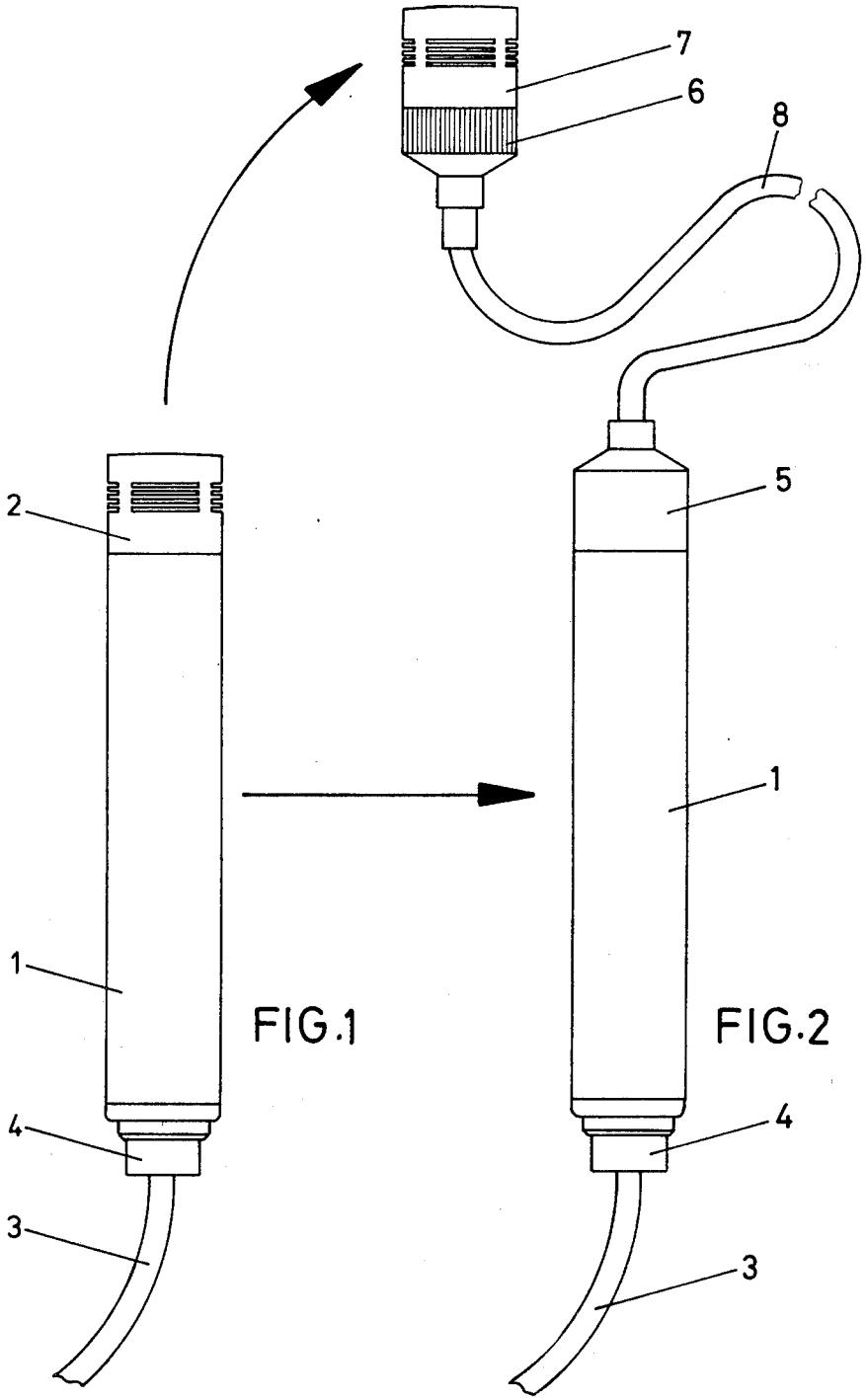
FIGS. 1 and 2 depict components of one exemplary set of components according to the invention connected together in a first mode, wherein the transducer is compactly connected to the housing containing the microphone amplifier, and in a second mode, wherein the same or a different transducer is connected to the housing containing the microphone amplifier by means of an extension unit.

FIG. 1 depicts the compact arrangement of a condenser microphone, comprised of a housing 1 containing the condenser-microphone amplifier circuitry and a removable transducer 2. The microphone cable 3 is connected to the microphone by means of a plug connection 4 and leads on, for example, to an amplifier.

In FIG. 2 a miniaturized accessory 6 is connected to the condenser-microphone amplifier 1. The cable 8 has ends, on the one hand, in the connecting portion 5 which effects the electrical and mechanical connections and, on the other hand, in the miniaturized housing 6. This housing 6 contains, inter alia, the electrical elements for the transformation of the high impedance of the transducer and is provided with the means for establishing electrical and mechanical connections for accommodating the transducer 7. In the illustrated exemplary embodiment, the cable 8 is fixedly connected with the housing 6. Alternatively, however, the housing 6 can be so constructed that the cable 8 is detachable from the accessory unit 6, although such alternative design may call for greater dimensions of the accessory unit 6.

Since the condenser-microphone amplifier 1 in FIG. 2 corresponds without modification to the condenser-microphone amplifier in the compact arrangement of FIG. 1, there is present for the removal of the transducer only one electrical and mechanical connecting location, at which either the transducer or the accessory unit is connected on. On the other hand, by means of the impedance transformation all detrimental influences upon the signal-to-noise ratio via the connector line (cable) are avoided. The low-impedance output of the impedance converter contained in the accessory unit is now terminated in a high-impedance, namely in the high-impedance input of the condenser-microphone amplifier. The cable 8 can be as long as desired.

Figure 1A:
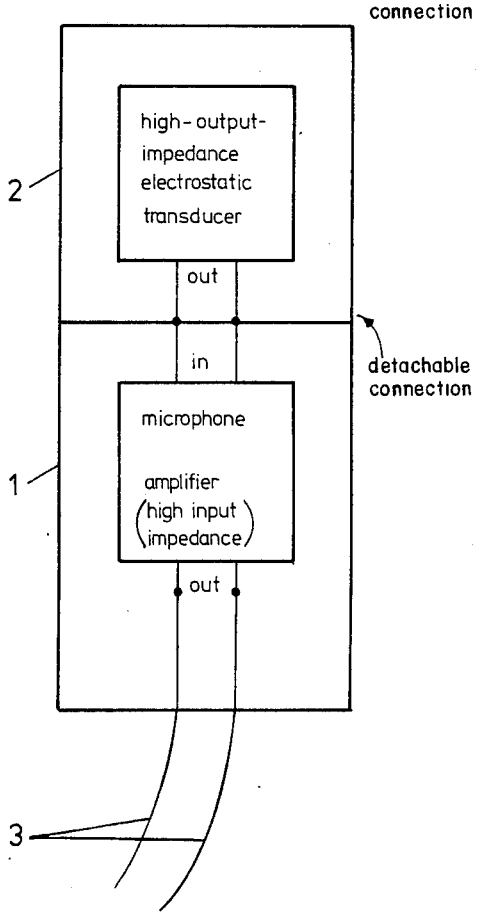
FIGS. 1*a* and 2*a* are schematic circuit diagrams of the circuitry contained in the various units depicted in FIGS. 1 and 2.
Figure 2A:
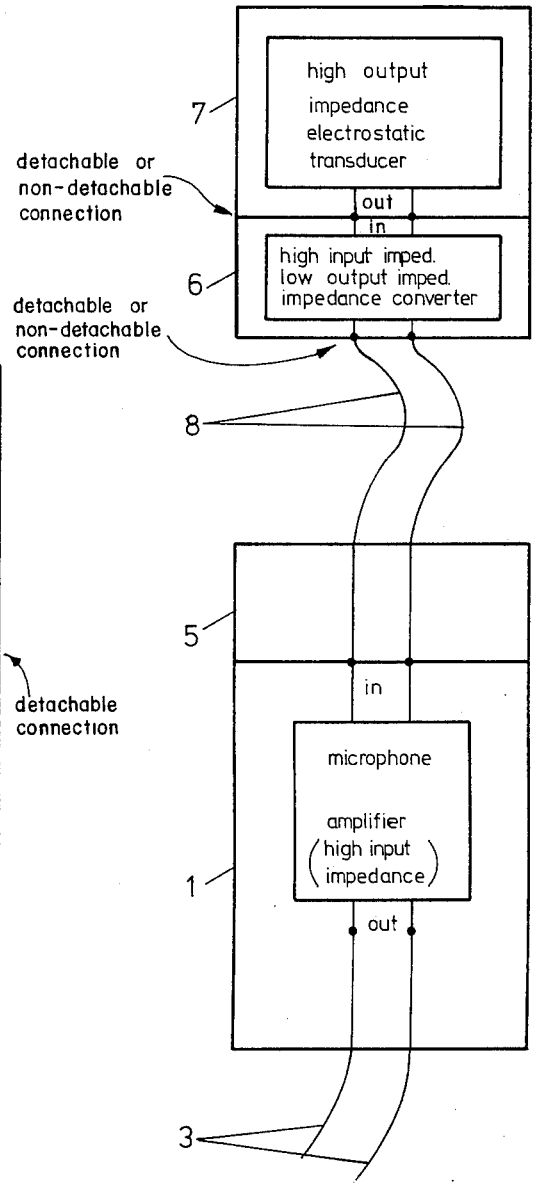

FIGS. 1*a* and 2*a* show the connections between the circuit stages contained in the components depicted in FIGS. 1 and 2.

In FIG. 1*a*, it will be seen that the output voltage signal of the high-output-impedance electrostatic transducer is applied to the high-impedance input of the microphone amplifier by means of electrical connecting conductors of short length. The impedance introduced by these short electrical connecting conductors is negligible, and it will be understood that the output voltage signal of the transducer is virtually fully applied to the microphone amplifier input.

In FIG. 2*a*, the high-output-impedance electrostatic transducer in unit 7 is connected to the high-impedance input of the microphone amplifier by means of the conductors in a relatively long cable 8. The impedance of these lengthy conductors is not negligible. If the high-impedance output of the transducer were connected, by means of the cable conductors 8 only, directly to the high-impedance input of the microphone amplifier, the non-negligible impedance of the conductors 8 would cause considerable attenuation in the transmitted transducer output voltage. Specifically, the total impedance in the circuit loop constituted by the output impedance of the transducer, the impedance of the conductors 8 and the input impedance of the microphone amplifier would increase. Accordingly, the fraction of the total impedance is this circuit constituted by the input impedance of the microphone amplifier would be considerably lower than in the set-up of FIG. 1 and, by reason of simple voltage division, the fraction of the transducer output voltage actually applied across the input of the microphone amplifier would be considerably reduced. As a result, the signal-to-noise ratio of the input signal would suffer, and the performance of the microphone would be markedly inferior in the mode of operaton depicted in FIG. 2.

The provision of the high-input-impedance low-output-impedance impedance converter in housing 6 very much changes the situation. Instead of the high output impedance of the transducer, the low output impedance of the impedance converter is to be considered in series with the impedance of the conductors 8 and the input impedance of the microphone amplifier. The increase of impedance in this loop due to the use of the long conductors 8 can be more than offset by the decrease in the output impedance of the impedance now connected to the input end of cable 8. The fraction of the total circuit impedance represented by the input impedance of the microphone amplifier in FIG. 2*a* will be equal to or even greater than the fraction of the total circuit impedance represented by the input impedance of the microphone amplifier in FIG. 1*a*. Accordingly, in changing over from the operating mode of FIGS. 1 and 1*a* to that of FIGS. 2 and 2*a* no deterioration of microphone performance will result.

With the inventive arrangement, the separation of the transducer from the condenser-microphone amplifier is accordingly achieved without any detrimental effect upon the quality of the microphone performance. The separation of the transducer from the condenser-microphone amplifier, according to the invention, can be accomplished in such a manner that instead of using for the electrical connector a cable, use can be made of connector leads running through a flexible tube. In such event, in known manner, the desired orientation of the transducer relative to the sound source can be very easily established. The flexible, metallic tubing can be prolonged by means of a metallic pipe without loss of the advantages described above.

When converting the microphone from the compact arrangement of FIG. 1 to the separated arrangement of FIG. 2, the transducer 2 is advantageously connected with the housing of accessory unit 6 to serve as the transducer for the accessory unit. Alternatively, the transducer 7 can be a further transducer non-detachably electrically connected to the electrical input of the impedance converter 6.

The circuit components provided in the accessory unit 6 are advantageously supplied by way of cable 8 by the same source of electrical energy which supplies the condenser-microphone amplifier 1. The particular circuitry employed determines the number of conductors which must be provided in the cable 8 or in the flexible metallic tubing, or the like. In this connection, it can be advantageous, in particular for the purpose of reducing the number of conductors which must be provided in the cable 8 or flexible metal tubing, to also provide several of the electrical components in the connector portion 5. Of course, the circuit components in the accessory unit 6 can be supplied by a separate source of electrical energy, which could in such case be provided, for example, in the connector portion 5. The transducers 2, 7 can also be constructed as electret transducers, in which case polarization voltage becomes unnecessary.

The mechanical connection of the parts can for example be effected by means of a bayonet-type connection or by means of a screw-threaded connection. In the latter case, the electrically contacting connecting elements can be fitted into one another and can be mechanically firmly held together by means of a clasp, lock or other holding means. If it is desired not to employ such clasp, lock or other holding means, then the requisite electrical contact connections can be established by means of a screw-threaded connection, with the screw-threaded mechanical connecting part being fixedly connected with the part which carries the electrical contacts. If more than one electrical contact connection is required to effect the electrical connection, then the electrical contacts employed should be arranged concentrically, and are preferably formed as sliding contact rings. The design can be such that the sliding contact rings are mounted on and project outwardly from an insulating contact plate in such a direction that when the mechanical connection is made by screwing together the screw-threaded parts, the projecting sliding contact rings enter into grooves provided on a cooperating connecting member made of insulating material, with electrically conductive contact lugs being located in such grooves. Thus both the mechanical and electrical connections would be established at the same time. This operaton would moreover effect a self-cleaning of the surfaces of the contacts. The screwthreads can be so selected as to pitch and thread number as to guarantee a sufficient self-locking action.

Figure 3:
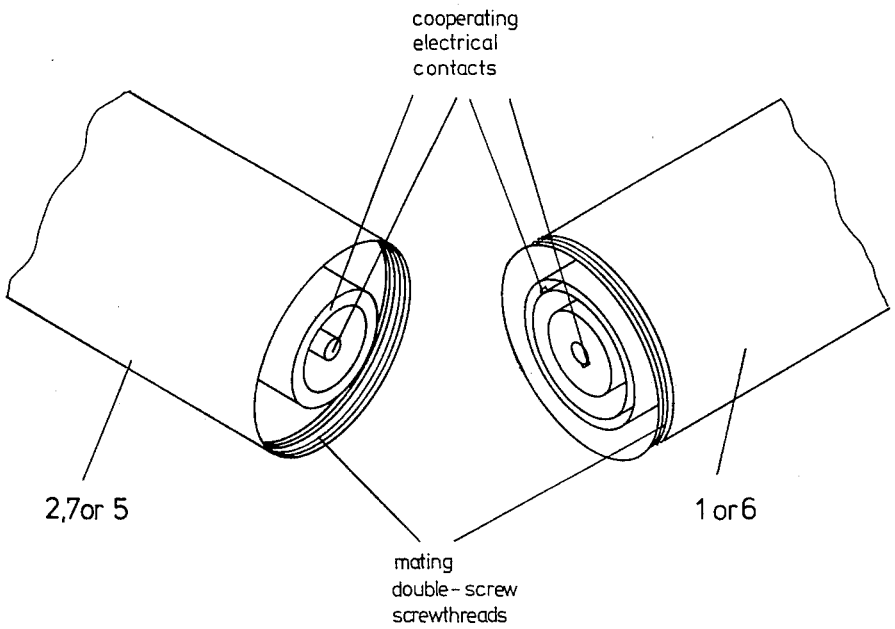
FIG. 3 depicts the manner in which the various units can be detachably connected to each other, both mechanically and electrically.

FIG. 3 depicts the manner in which the components 2, 7 or 5, on the one hand, can be detachably connected to the units 1 or 6, on the other hand. Use is made of mating double-screw screwthreads on the components to be connected. A double-screw screwthread consists of two distinct screwthreads so disposed that the individual turns of one thread alternate with the individual turns of the other thread. The advantage of using a multiple-thread screwthread, in this context, is that compared to a single-thread screwthread having the same total number of thread turns, substantially the same holding action can be achieved after performing only about one half as many turns. This reduces the tendency for the connector 8 to become inconveniently twisted during changeovers.

It is also possible to provide, between the condenser-microphone amplifier 1 and the connector cap in conventional manner, a capacitive voltage divider, as a damping stage.

It will be understood that each of the elements described above, or two or more together, may also find a useful application in other types of constructions differing from the types described above.

While the invention has been illustrated and described as embodied in a particular condenser microphone arrangement, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention.

What is claimed as new and desired to be protected by Letters Patent is set forth in the appended:

1. A set of components connectable together to form different microphone constructions, comprising, in combination, a first unit containing a microphone amplifier having an electrical input provided with electrical input contact means, said first unit having a first connecting portion; a second unit containing an electrostatic microphone transducer having an electrical output provided with electrical output contact means, said second unit having a second connecting portion, said first and second connecting portions being so configured as to be detachably connectable to each other, with said electrical output contact means of said transducer and said electrical input contact means of said microphone amplifier being so disposed relative to said first and second connecting portions, respectively, that when the latter are connected to each other said electrical output contact means of said transducer becomes electrically connected to said electrical input contact means of said microphone amplifier; a third unit containing an impedance converter circuit having a high-impedance electrical input adapted for electrical connection to a microphone transducer and a low-impedance electrical output provided with electrical output contact means, said third unit having a respective third connecting portion, said first and third connecting portions being so configured as to be detachably connectable to each other, with said electrical output contact means of said impedance converter circuit and said electrical input contact means of said microphone amplifier being so disposed relative to said first and third connecting portions, respectively, that when the latter are connected to each other said electrical output contact means of said impedance converter circuit becomes electrically connected to said electrical input contact means of said microphone amplifier.

2. A set as defined in claim 1, said third unit having an additional connecting portion, said second and said additional connecting portions being so configured as to be detachably connectable to each other, with said electrical output contact means of said transducer and said electrical input contact means of said impedance converter circuit being so disposed relative to said second and said additional connecting portions, respectively, that when the latter are connected to each other said electrical output contact means of said transducer becomes electrically and operatively but detachably connected to said electrical input contact means of said impedance converter circuit.

3. A set as defined in claim 1, wherein at least some of said connecting portions are screw-threaded connecting portions.

4. A set as defined in claim 1, said transducer constituting a first transducer, and further including a fourth unit containing a further electrostatic microphone transducer having an electrical output provided with electrical output contact means, said fourth unit having a fourth connecting portion, said first and fourth connecting portions being so configued as to be detachably connectable to each other, with said electrical output contact means of said further transducer and said electrical input contact means of said microphone amplifier being so disposed relative to said first and fourth connecting portions, respectively, that when the latter are connected to each other said electrical output contact means of said further transducer becomes electrically and operatively but detachably connected to said electrical input contact means of said microphone amplifier.

5. A set of components connectable together to form different microphone constructions, comprising, in combination, a first unit containing a microphone amplifier having an electrical input provided with electrical input contact means, said first unit having a first connecting portion; a second unit containing an electrostatic microphone transducer having an electrical output provided with electrical output contact means, said second unit having a second connecting portion, said first and second connecting portions being so configured as to be detachably connectable to each other, with said electrical output contact means of said transducer and said electrical input contact means of said microphone amplifier being so disposed relative to said first and second connecting portions, respectively, that when the latter are connected to each other said electrical output contact means of said transducer becomes electrically connected to said electrical input contact means of said microphone amplifier; a third unit containing an impedance converter circuit having a high-impedance electrical input adapted for electrical connection to a microphone transducer and a low-impedance electrical output provided with electrical output contact means, said third unit having a third connecting portion, said first and third connecting portions being so configured as to be detachably connectable to each other, with said electrical output contact means of said impedance converter circuit and said electrical input contact means of said microphone amplifier being so disposed relative to said first and third connecting portions, respectively, that when the latter are connected to each other said electrical output contact means of said impedance converter circuit becomes electrically connected to said electrical input contact means of said microphone amplifier, said transducer constituting a first transducer, and said third unit additionally containing a further transducer having an electrical output provided with electrical output contact means non-detachably electrically connected to said electrical input contact means of said impedance converter circuit.

6. A set as defined in claim 5, wherein said first transducer and said further transducer have substantially identical electromechanical transducer characteristics.

7. A set as defined in claim 5, wherein said first transducer and said further transducer have different electromechanical transducer characteristics.

8. A set as defined in claim 5, wherein said third unit comprises elongated conductor means having one end electrically connected to said electrical output of said impedance converter circuit and having another end provided with electrical contacts constituting said electrical output contact means of said impedance converter circuit.

9. A set of components connectable together to form different micropone constructions, comprising, in combination, a first unit containing a microphone amplifier having an electrical input provided with electrical input contact means, said first unit having a first connecting portion; a second unit containing an electrostatic microphone transducer having an electrical output provided with electrical output contact means, said second unit having a second connecting portion, said first and second connecting portions being so configured as to be detachably connectable to each other, with said electrical output contact means of said transducer and said electrical input contact means of said microphone amplifier being so disposed relative to said first and second connecting portions, respectively, that when the latter are connected to each other said electrical output contact means of said transducer becomes electrically connected to said electrical input contact means of said microphone amplifier; a third unit containing an impedance converter circuit having a high-impedance electrical input adapted for electrical connection to a microphone transducer and a low-impedance electrical output provided with electrical output contact means, said third unit having a third connecting portion, said first and third connecting portions being so configured as to be detachably connectable to each other, with said electrical output contact means of said impedance converter circuit and said electrical input contact means of said microphone amplifier being so disposed relative to said first and third connecting portions, respectively, that when the latter are connected to each other said electrical output contact means of said impedance converter circuit becomes electrically connected to said electrical input contact means of said microphone amplifier, said third unit having an additional connecting portion, said second and said additional connecting portions being so configured as to be detachably connectable to each other, with said electrical output contact means of said transducer and said electrical input contact means of said impedance converter circuit being so disposed relative to said second and said additional connecting portions, respectively, that when the latter are connected to each other said electrical output contact means of said transducer becomes electrically and operatively but detachably connected to said electrical input contact means of said impedance converter circuit, wherein said third unit comprises elongated conductor means having one end electrically connected to said electrical output of said impedance converter circuit and having another end provided with electrical contacts constituting said electrical output contact means of said impedance converter circuit.

10. A set of components connectable together to form different microphone constructions, comprising, in combination, a first unit containing a microphone amplifier having an electrical input provided with electrical input contact means, said first unit having a first connecting portion; a second unit containing an electrostatic microphone transducer having an electrical output provided with electrical output contact means, said second unit having a second connecting portion, said first and second connecting portions being so configured as to be detachably connectable to each other, with said electrical output contact means of said transducer and said electrical input contact means of said microphone amplifier being so disposed relative to said first and second connecting portions, respectively, that when the latter are connected to each other said electrical output contact means of said transducer becomes electrically connected to said electrical input contact means of said microphone amplifier; a third unit containing an impedance converter circuit having a high-impedance electrical input adapted for electrical connection to a microphone transducer and a low-impedance electrical output provided with electrical output contact means, said third unit having a third connecting portion, said first and third connecting portions being so configured as to be detachably connectable to each other, with said electrical output contact means of said impedance converter circuit and said electrical input contact means of said microphone amplifier being so disposed relative to said first and third connecting portions, respectively, that when the latter are connected to each other said electrical output contact means of said impedance converter circuit becomes electrically connected to said electrical input contact means of said microphone amplifier, said transducer constituting a first transducer, and further including a fourth unit containing a further electrostatic microphone transducer having different transducer characteristics and an electrical output provided with electrical output contact means, said fourth unit having a fourth connecting portion, said first and fourth connecting portions being so configured as to be detachably connectable to each other, with said electrical output contact means of said further transducer and said electrical input contact means of said microphone amplifier being so disposed relative to said first and fourth connecting portions, respectively, that when the latter are connected to each other said electrical output contact means of said further transducer becomes electrically and operatively but detachably connected to said electrical input contact means of said microphone amplifier, wherein said third unit comprises elongated conductor means having one end electrically connected to said electrical output of said impedance converter circuit and having another end provided with electrical contacts constituting said electrical output contact means of said impedance converter circuit.

11. A set of components connectable together to form different microphone constructions, comprising, in combination, a first unit containing a microphone amplifier having an electrical input provided with electrical input contact means, said first unit having a first connecting portion; a second unit containing an electrostatic microphone transducer having an electrical output provided with electrical output contact means, said second unit having a second connecting portion, said first and second connecting portions being so configured as to be detachably connectable to each other, with said electrical output contact means of said transducer and said electrical input contact means of said microphone amplifier being so disposed relative to said first and second connecting portions, respectively, that when the latter are connected to each other said electrical output contact means of said transducer becomes electrically connected to said electrical input contact means of said microphone amplifier; a third unit containing an impedance converter circuit having a high-impedance electrical input adapted for electrical connection to a microphone transducer and a low-impedance electrical output provided with electrical output contact means, said third unit having a third connecting portion, said first and third connecting portions being so configured as to be detachably connectable to each other, with said electrical output contact means of said impedance converter circuit and said electrical input contact means of said microphone amplifier being so disposed relative to said first and third connecting portions, respectively, that when the latter are connected to each other said electrical output contact means of said impedance converter circuit becomes electrically connected to said electrical input contact means of said microphone amplifier, wherein said third unit comprises elongated conductor means having one end electrically connected to said electrical output of said impedance converter circuit and having another end provided with electrical contacts constituting said electrical output contact means of said impedance converter circuit.

12. A set as defined in claim 11, wherein said elongated conductor means is detachably connected to said electrical output of said impedance converter circuit for repeated disconnection therefrom and reconnection thereto.

13. A set as defined in claim 11, wherein said elongated conductor means comprises an elongated cable.

14. A set as defined in claim 11, wherein said elongated conductor means comprises an elongated flexible tube and electrical conductors running through the interior of said elongated flexible tube.

15. A set as defined in claim 11, wherein said first, second and third connecting portions are screwthreaded connecting portions.

16. A set as defined in claim 15, wherein said screwthreaded connecting portions are provided with multiple-thread screwthreads, whereby when said first and third connecting portions are screwed together the twisting of said elongated conductor means which will result will be less than if said screwthreaded connecting portions were provided with only single-thread screwthreads.

* * * * *